US006732693B2

(12) United States Patent
Ito et al.

(10) Patent No.: US 6,732,693 B2
(45) Date of Patent: May 11, 2004

(54) VALVE-OPERATING ASSEMBLY OF DRIVEN ROTATION MEMBER AND CAM

(75) Inventors: Keita Ito, Wako (JP); Shigeki Edamatsu, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/218,032

(22) Filed: Aug. 14, 2002

(65) Prior Publication Data

US 2003/0041821 A1 Mar. 6, 2003

(30) Foreign Application Priority Data

Aug. 29, 2001 (JP) ..... 2001-259939

(51) Int. Cl.[7] ..... F01L 1/04

(52) U.S. Cl. ..... 123/90.6; 123/90.16; 123/90.31; 123/90.17

(58) Field of Search ..... 123/90.15, 90.16, 123/90.17, 90.18, 90.31, 90.6; 74/568 R; 464/1, 2, 160; 92/121, 122

(56) References Cited

U.S. PATENT DOCUMENTS 5,168,772 A * 12/1992 Adamis et al. ..... 74/568 R
5,979,381 A * 11/1999 Korostenski et al. .... 123/90.17
6,055,952 A * 5/2000 Gau ..... 123/182.1

* cited by examiner

*Primary Examiner*—Thomas Denion
*Assistant Examiner*—Jaime Corrigan
(74) *Attorney, Agent, or Firm*—Westerman, Hattori, Daniels & Adrian, LLP

(57) ABSTRACT

In a valve-operating assembly of a driven rotation member and a cam, including a hub rotatably carried on a support shaft, a cam formed on an outer periphery of one end of the hub, and a driven rotation member coupled to one end of the cam; the cam and the hub are integrally formed of a sintered alloy; the cam has a recess defined in one end face thereof; and the driven rotation member is made of a synthetic resin, and mold-coupled to the cam and the hub so that the recess is filled with the synthetic resin of the driven rotation member and an outer periphery of the hub is wrapped with the synthetic resin. Thus, it is possible to provide the valve-operating assembly of the driven rotation member and the cam, which is lightweight and excellent in lubrication of the cam and the hub.

2 Claims, 11 Drawing Sheets

VALVE-OPERATING ASSEMBLY OF DRIVEN ROTATION MEMBER AND CAM

BACKGROUND OF THE INVENTION

1. Field of the Invention

The present invention relates to an improvement in a valve-operating assembly of a driven rotation member and a cam, comprising a hub rotatably carried on a support shaft supported on an engine body, a cam formed on an outer periphery of one end of the hub, and a driven rotation member coupled to one end of the cam.

2. Description of the Related Art

A conventional valve-operating assembly of a driven rotation member and a cam is known as disclosed, for example, in Japanese Patent Application Laid-open No. 8-177416.

The conventional valve-operating assembly of the driven rotation member and the cam is entirely made of a metal, and hence has an increased weight due to the driven rotation member of a relatively large diameter, thereby hindering the reduction in weight of an engine to some extent.

SUMMARY OF THE INVENTION

Accordingly, it is an object of the present invention to provide a valve-operating assembly of a driven rotation member and a cam, which is lightweight and moreover, is excellent in lubrication of the cam and hub.

To achieve the above object, according to a first feature of the present invention, there is provided a valve-operating assembly of a driven rotation member and a cam, comprising a hub rotatably carried on a support shaft supported on an engine body, a cam formed on an outer periphery of one end of the hub, and a driven rotation member coupled to one end of the cam, wherein the cam and the hub are integrally formed of a sintered alloy; wherein the cam has a recess defined in one end face thereof; and wherein the driven rotation member is made of a synthetic resin and mold-coupled to the cam and the hub so that the recess is filled with the synthetic resin of the driven rotation member and an outer periphery of the hub is wrapped with the synthetic resin. The driven rotation member corresponds to a driven pulley 25 in an embodiment of the present invention, which will be described hereinafter.

With the first feature, the driven rotation member is made of the synthetic resin and hence, is relatively lightweight in spite of its relatively large diameter. This can contribute to a reduction in weight of the assembly of the driven rotation member and the cam, and in turn to a reduction in weight of an engine.

Moreover, since the driven rotation member is mold-coupled to the cam and hub, a special securing means is not required, leading to a further reduction in weight of the assembly.

Further, since the recess is filled with a material of the driven rotation member made and an outer periphery of the hub is wrapped with the material upon mold-coupling of the driven rotation member to the cam and the hub, coupling forces of the driven rotation member to the cam and hub in rotational and axial directions can be increased.

According to a second feature of the present invention, in addition to the first feature, the recess is formed so that the shape of its inner surface substantially corresponds to that of an outer peripheral surface of the cam.

With the second feature, the recess is of the shape substantially corresponding to the outer peripheral surface of the cam and hence, the coupling force of the driven rotation member to the cam, particularly in the rotational direction, can be increased effectively. Moreover, the wall thickness of the cam around the recess is substantially uniform, and hence the thermal deformation during sintering of the cam can be suppressed to contribute to an enhancement in accuracy of a cam profile.

The above and other objects, features and advantages of the invention will become apparent from the following description of the preferred embodiment taken in conjunction with the accompanying drawings.

DESCRIPTION OF THE PREFERRED EMBODIMENT

Figure 1:
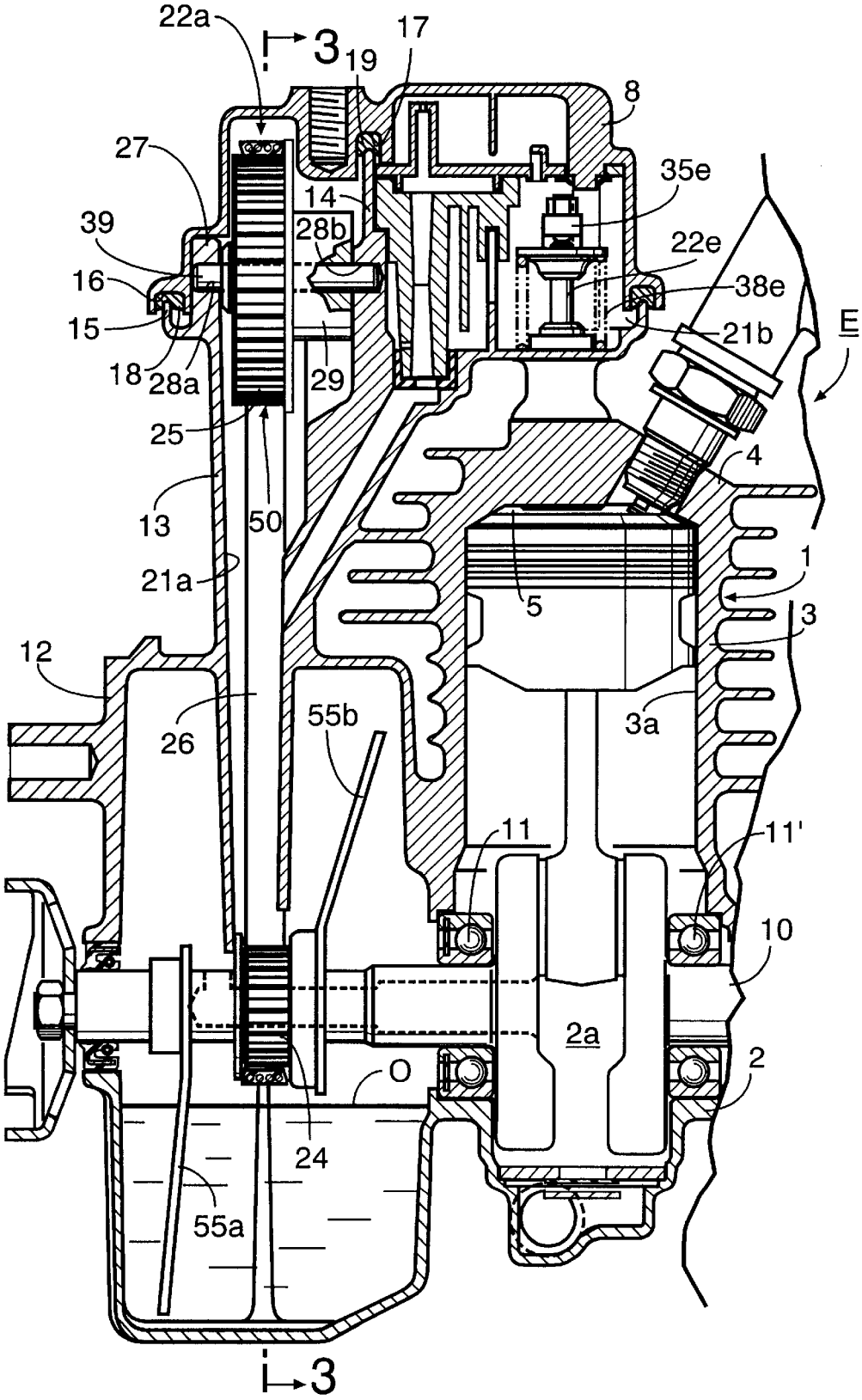
FIG. 1 is a vertical sectional view of an engine having a valve-operating mechanism according to the present invention.
Figure 2:
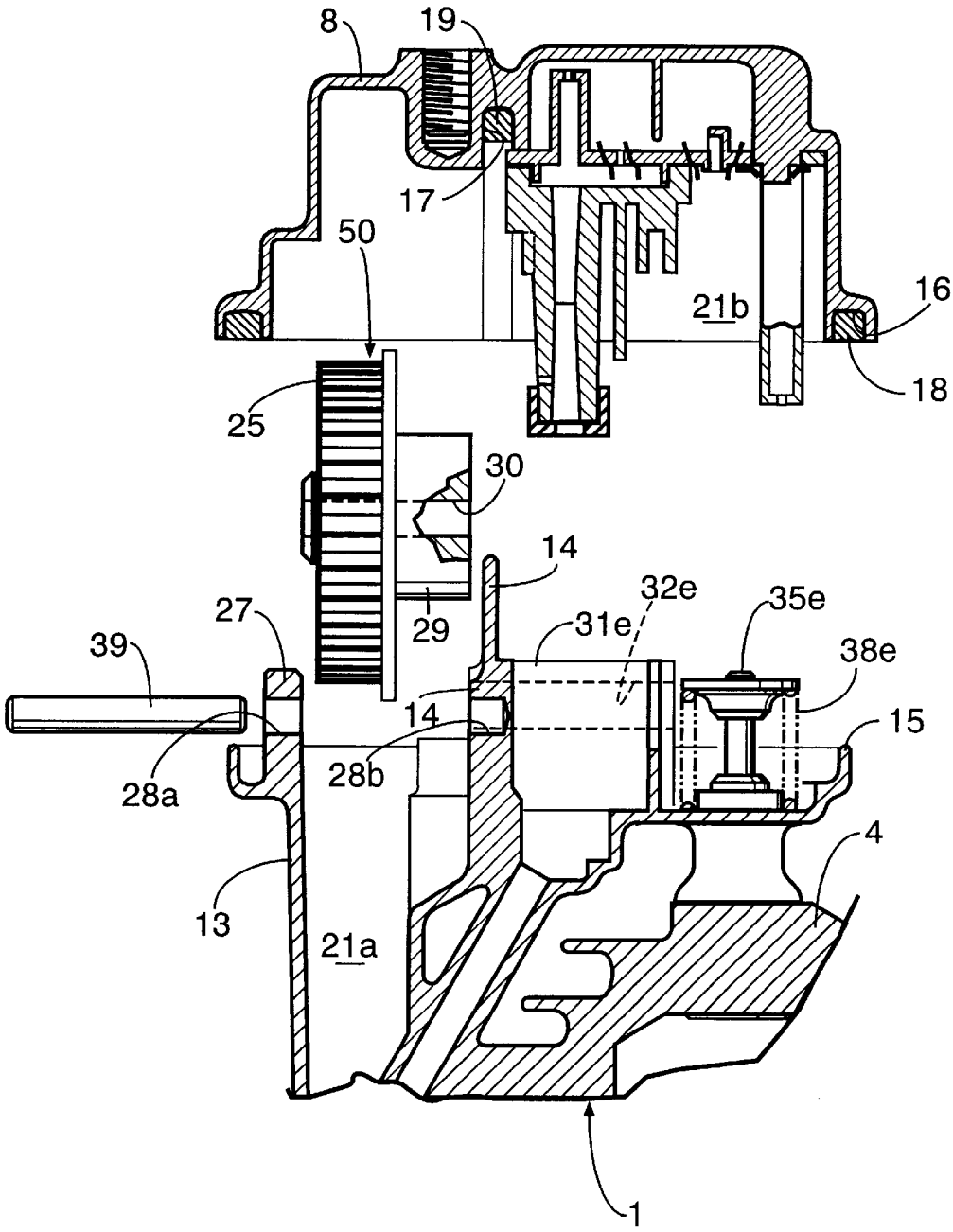
FIG. 2 is an exploded view of an essential portion of FIG. 1.
Figure 3:
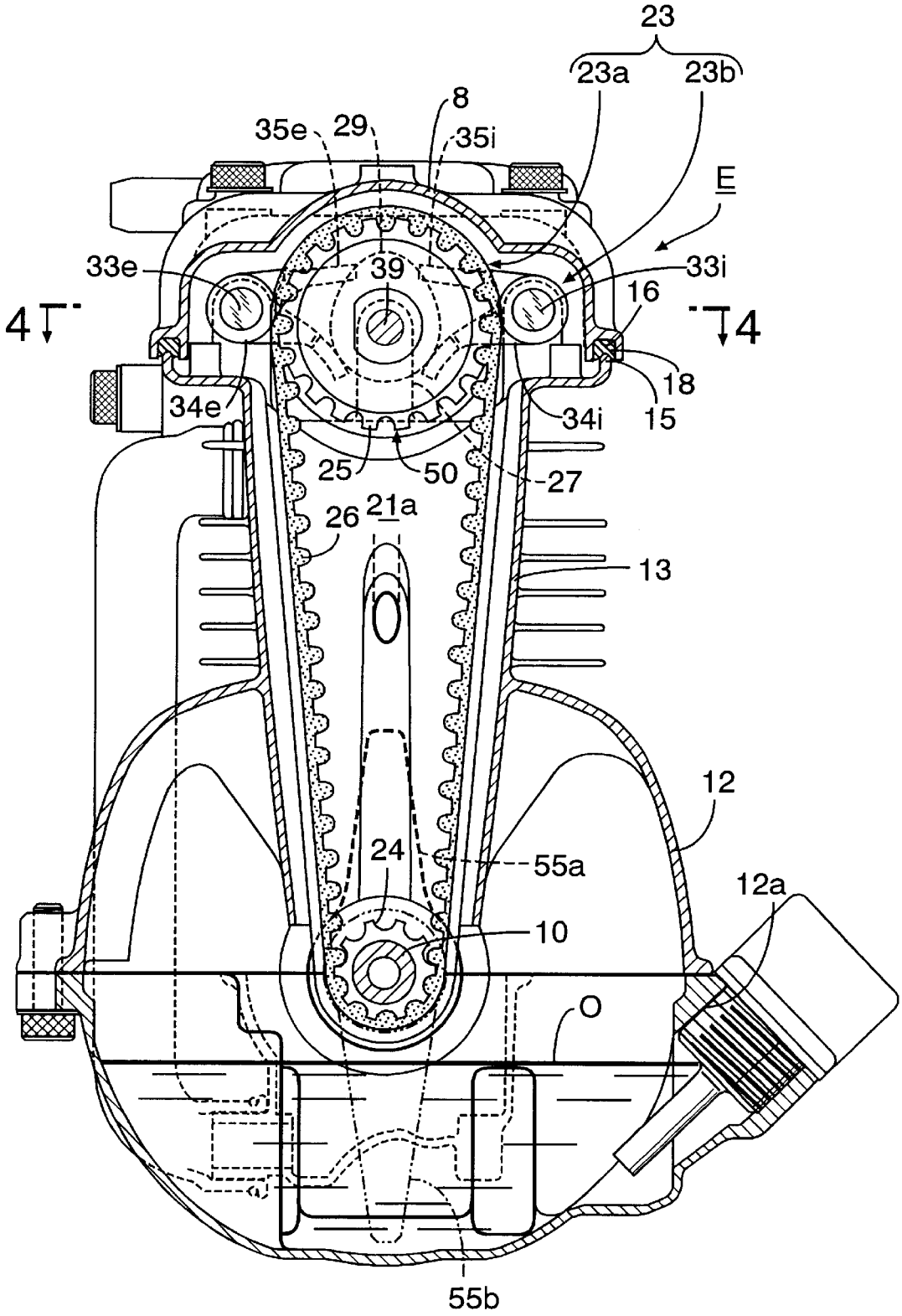
FIG. 3 is a sectional view taken along a line 3—3 in FIG. 1.

The present invention will now be described by way of an embodiment shown in the accompanying drawings.

Referring first to FIGS. 1 to 4 and 6, an engine body 1 of an engine E comprises a crankcase 2 having a crank chamber 2*a*, a cylinder block 3 having a single cylinder bore 3*a*, and a cylinder head 4 having a combustion chamber 5 and intake and exhaust ports 6 and 7 which open into the combustion chamber 5.

A crankshaft 10 accommodated in the crank chamber 2*a* is carried on laterally opposite sidewalls of the crankcase 2 with bearings 11 and 11' interposed therebetween.

An oil tank 12 is integrally connected to the left sidewall of the crankcase 2 adjacent the outer side thereof, and one end of the crankshaft 10 is oil-tightly passed through the oil tank 12.

A belt guide tube 13 flat in section is integrally connected to a ceiling wall of the oil tank 12 to extend vertically through the ceiling wall. A lower end of the belt guide tube 13 extends to the vicinity of the crankshaft 10 within the oil tank 12. An upper end of the belt guide tube 13 is integrally connected to the cylinder head 4 so that it shares a partition wall 14 jointly with the cylinder head 4. A series of annular seal beads 15 are formed at peripheral edges of the cylinder head 4 and the upper end of the belt guide tube 13, and the partition wall 14 protrudes upwards from the seal beads 15.

An annular seal groove 16 is defined in a lower end face of a head cover 8 coupled to an upper end of the cylinder head 4 to correspond to the seal beads 15. A linear seal groove 17 is defined in an inner surface of the head cover 8 to permit the communication between opposite sides of the annular seal groove 16. An annular packing 18 is mounted in the annular seal groove 16, and a linear packing 19 is formed integrally with the annular packing 18 is mounted in the linear seal groove 17. The head cover 8 is coupled to the cylinder head 4 by a bolt so that the seal beads 15 are brought into pressure contact with the annular packing 18, and the partition wall 14 is brought into pressure contact with the linear packing 19.

A first valve-operating chamber 21*a* is defined by the belt guide tube 13 and one of halves of the head cover 8. A second valve-operating chamber 21*b* is defined by the cylinder head 4 and the other half of the head cover 8. The valve-operating chambers 21*a* and 21*b* are partitioned from each other by the partition wall 14.

An intake valve 22*i* and an exhaust valve 22*e* for opening and closing the intake port 6 and the exhaust port 7 respectively are disposed in the cylinder head 4 in parallel to the cylinder bore 7*a*.

A valve-operating mechanism 23 for opening and closing the intake valve 22*i* and the exhaust valve 22*e* according to the present invention will be described below.

Referring again to FIGS. 1 to 6, the valve-operating mechanism 23 comprises a timing transmitting device 23*a* disposed to extend from the inside of the oil tank 12 into the first valve-operating chamber 21*a*, and a cam device 23*b* disposed to extend from the first valve-operating chamber 21*a* into the second valve-operating chamber 21*b*.

The timing transmitting device 23*a* comprises a driving pulley 24 fixedly mounted on the crankshaft 13 within the oil tank 12, a driven pulley 25 rotatably supported at an upper portion of the belt guide tube 13, and a timing belt 26 reeved between the driving and driven pulleys 24 and 25. A hub 30 and a cam 29 are integrally formed on the driven pulley 25, thereby constituting a driven pulley/cam assembly 50. In this way, the cam 29 is disposed along with the driven pulley 25 on one side of the cylinder head 4. The driving and driven pulleys 24 and 25 are toothed so that the driving pulley 24 drives the driven pulley 25 at a reduction ratio of ½ through the belt 26.

A support wall 27 is integrally formed on an outer sidewall of the belt guide tube 13, so that it rises inside the annular seal beads 15 to abut against or extend to near the inner surface of the head cover 8. A support shaft 39 is rotatably supported at its opposite ends in a through-bore 28*a* provided in the support wall 27 and a bottomed bore 28*b* provided in the partition wall 14. The hub 30 is rotatably supported at an intermediate portion of the support shaft 39. The support shaft 29, before mounted to the head cover 8, is inserted from the through-bore 28*a*, through a shaft bore 35 of the driven pulley 25 and the cam 29, into the bottomed bore 28*b*. After the insertion of the support shaft 39, when the head cover 8 is coupled to the cylinder head 4 and the belt guide tube 13, the inner surface of the head cover 8 is opposed to an outer end of the support shaft 39, to prevent the slipping-out of the support shaft 39.

A pair of bearing bosses 31*i* and 31*e* are integrally formed on the cylinder head 4 to protrude from the partition wall 14 in parallel to the support shaft 39 toward the second valve-operating chamber 21*b*. The cam device 23*b* comprises the cam 29, an intake rocker shaft 33*i* and an exhaust rocker shaft 33*e* rotatably supported in bearing bores 32*i* and 32*e* in the bearing bosses 31*i* and 31*e*, respectively, an intake cam follower 34*i* and an exhaust cam follower 34*e* each press-fitted to one end of each of the rocker shafts 33*i* and 33*e* to extend toward the cam 29, an intake rocker arm 35*i* and an exhaust rocker arm 35*e* press-fitted to the other ends of the intake and exhaust rocker shafts 33*i* and 33*e* in the second valve-operating chamber 21*b* to extend toward the intake valve 22*i* and the exhaust valve 22*e*, and an intake spring 38*i* and an exhaust spring 38*e* mounted on the intake valve 22*i* and the exhaust valve 22*e* for biasing these valve 22*i* and 22*e* in closing directions. The intake cam follower 34*i* and the exhaust cam follower 34*e* are disposed so that slipper faces 36, 36 formed on upper surfaces of their tip ends are in sliding contact with the lower surface of the cam 29. The intake rocker arm 35*i* and the exhaust rocker arm 35*e* are disposed so that adjusting bolts 37, 37 threadedly mounted in their tip ends are in abutment against upper ends of the intake valve 22*i* and the exhaust valve 22*e*.

The support shaft 39 and the intake and exhaust rocker shafts 33*i* and 33*e* are disposed above the annular seal beads 15 at the cylinder head 4 and the upper end of the belt guide tube 13. Therefore, in a state in which the head cover 8 is removed, the assembling and disassembling of the support shaft 39 and the intake and exhaust rocker shafts 33*i* and 33*e* can be conducted above the seal bead 15 without being obstructed by the seal beads 15 in any way, leading to excellent assemblability and maintenance.

Referring to FIGS. 5 to 8, abutment faces 40*i* and 40*e* are formed respectively on backs of the intake cam follower 34*i* and the exhaust cam follower 34*e* opposite from the slipper faces 36, 36, in parallel to axes of the rocker shafts 33*i* and 33*e*. Abutment faces 41*i* and 41*e* are formed respectively on backs of the intake rocker arm 35*i* and the exhaust rocker arm 35*e* opposite from protruding portions of the adjusting bolts 37, 37. On the other hand, reference faces 42*i* and 42*e* as well as reference faces 43*i* and 43*e* are formed on the cylinder head 4 so that the reference faces 42*i* and 42*e* face the abutment faces 40*i* and 40*e* when the intake cam follower 34*i* and the intake rocker arm 35*i* are turned outwards and sideways of the cylinder head, and so that the reference faces 43*i* and 43*e* confront the abutment faces 41*i* and 41*e*, when the exhaust cam follower 34*e* and the exhaust rocker arm 35*e* are turned outwards and sideways of the cylinder head.

If phases of the intake cam follower 34*i* and the intake rocker arm 35*i* are appropriate relative to each other around the intake rocker shaft 33*i*, the abutment faces 40*i* and 41*i* and the reference faces 42*i* and 43*i* abut against each other simultaneously. If phase of the exhaust cam follower 34*e* and the exhaust rocker arm 35*e* are likewise appropriate relative to each other around the exhaust rocker shaft 33*e*, the abutment faces 40*e* and 41*e* and the reference faces 42*e* and 43*e* abut against each other simultaneously. All the reference faces 42*i*, 42*e*, 43*i* and 43*e* are disposed at the same height, so that they can be worked simultaneously.

Figure 7A:
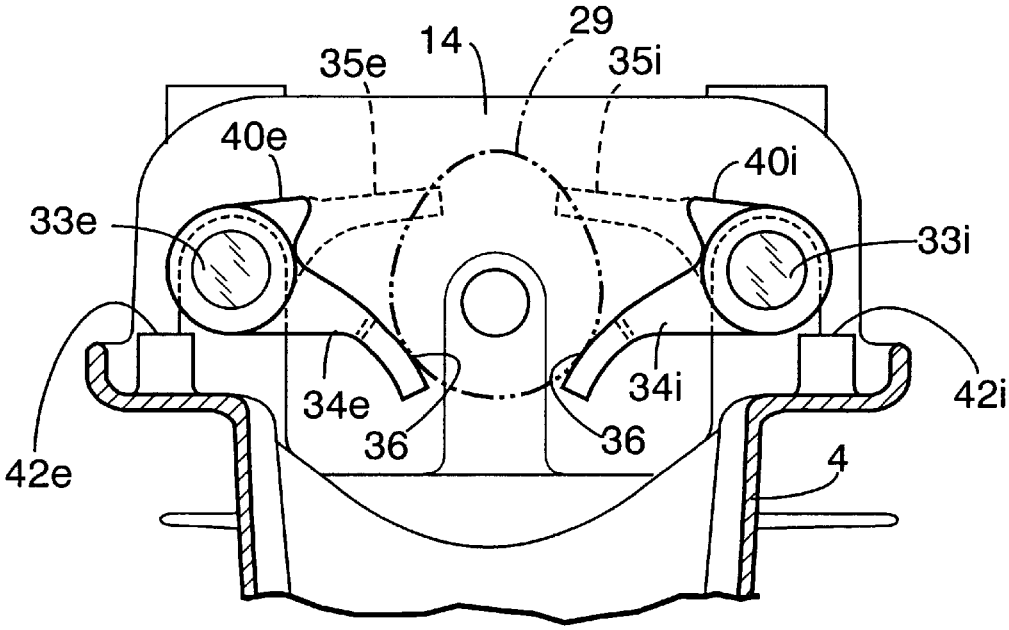
FIGS. 7A and 7B are views corresponding to FIG. 5, but showing a process for assembling the valve-operating mechanism.
Figure 7B:
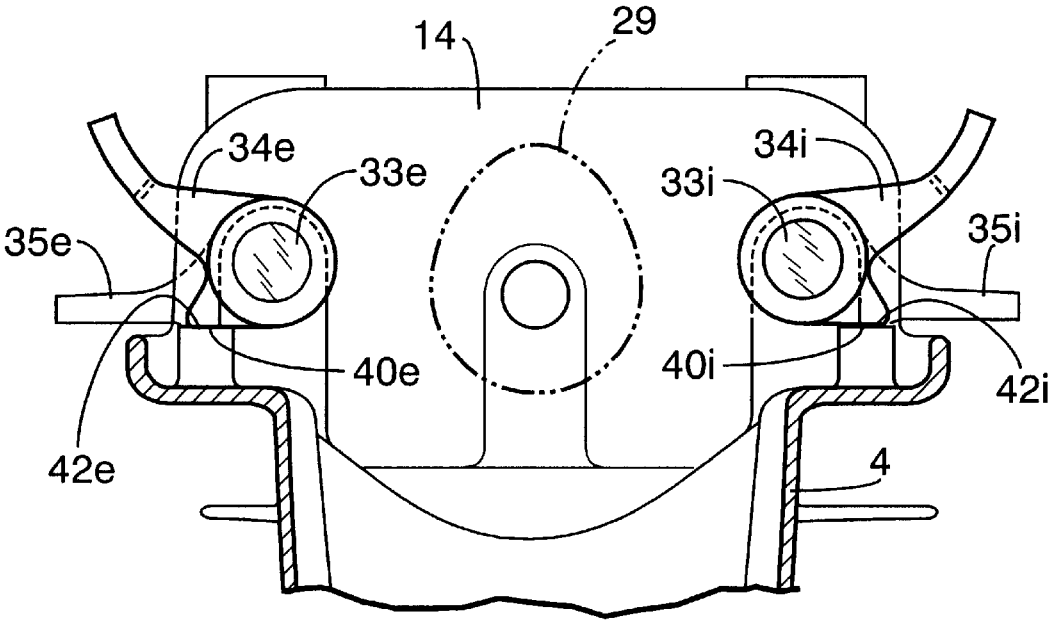
Figure 8A:
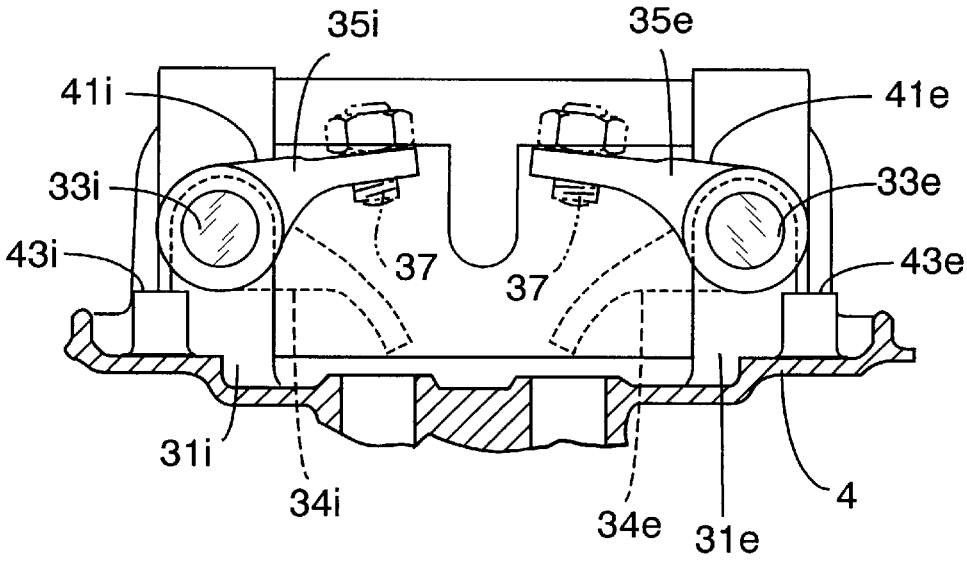
FIGS. 8A and 8B are also views corresponding to FIG. 6, but showing the process for assembling the valve-operating mechanism.
Figure 8B:
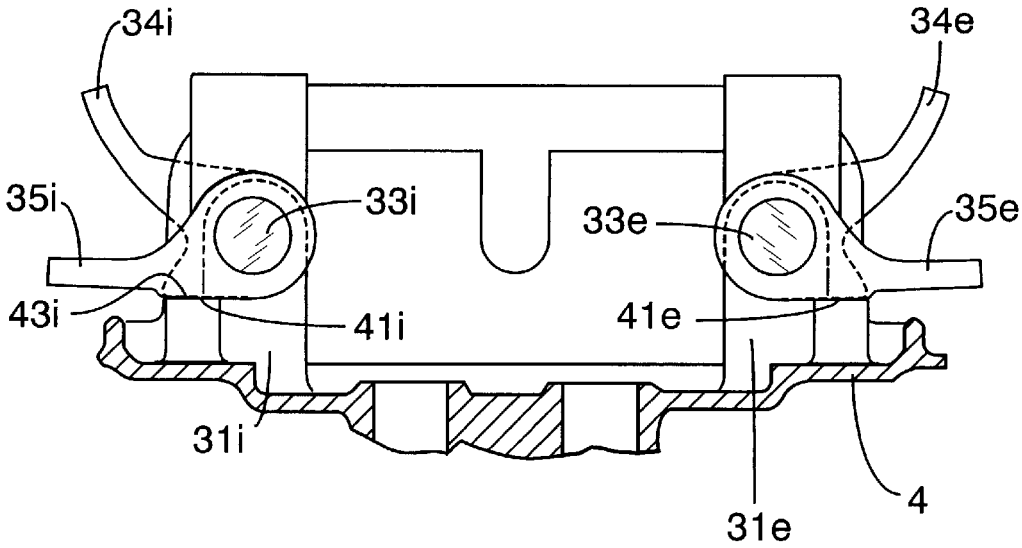

To assemble the intake cam follower 34*i* and the intake rocker arm 35*i* to the intake rocker shaft 33*i*, for example, the intake cam follower 34*i* is first press-fitted and secured to one ends of the rocker shafts 33*i* and 33*e*, and the rocker shaft 33*i* and 33*e* are inserted into the bearing bores 32*i* and 32*e*. Then, as shown in FIGS. 7B and 8B, the intake rocker arm 35*i* is turned outwards and sideways from the cylinder head 4, and the abutment faces 40*i* and 40*e* are put into abutment against the corresponding reference faces 42*i* and 42*e*. In this state, if the intake rocker arm 35*i* is press-fitted and secured to the other ends of the rocker shafts 33*i* and 33*e* while putting its abutment faces 41*i* and 41*e* into abutment against the corresponding reference faces 43*i* and 43*e*, the phases of the intake cam follower 34*i* and the intake rocker arm 35*i* can be appropriately established relative to each other around the intake rocker shaft 33*i*. Of course, the phases of the exhaust cam follower 34*e* and the exhaust rocker arm 35*e* can be appropriately established relative to each other around the exhaust rocker shaft 33*e* in the same manner. The same effect is also obtained in the case where the rocker arms 35*i* and 35*e* are first press-fitted to the rocker shafts 33*i* and 33*e*. After the assembling, the cam followers 34*i* and 34*e* and the rocker arms 35*i* and 35*e* are turned to service positions at a central portion of the cylinder head 4, as shown in FIGS. 7A and 8A.

Figure 4:
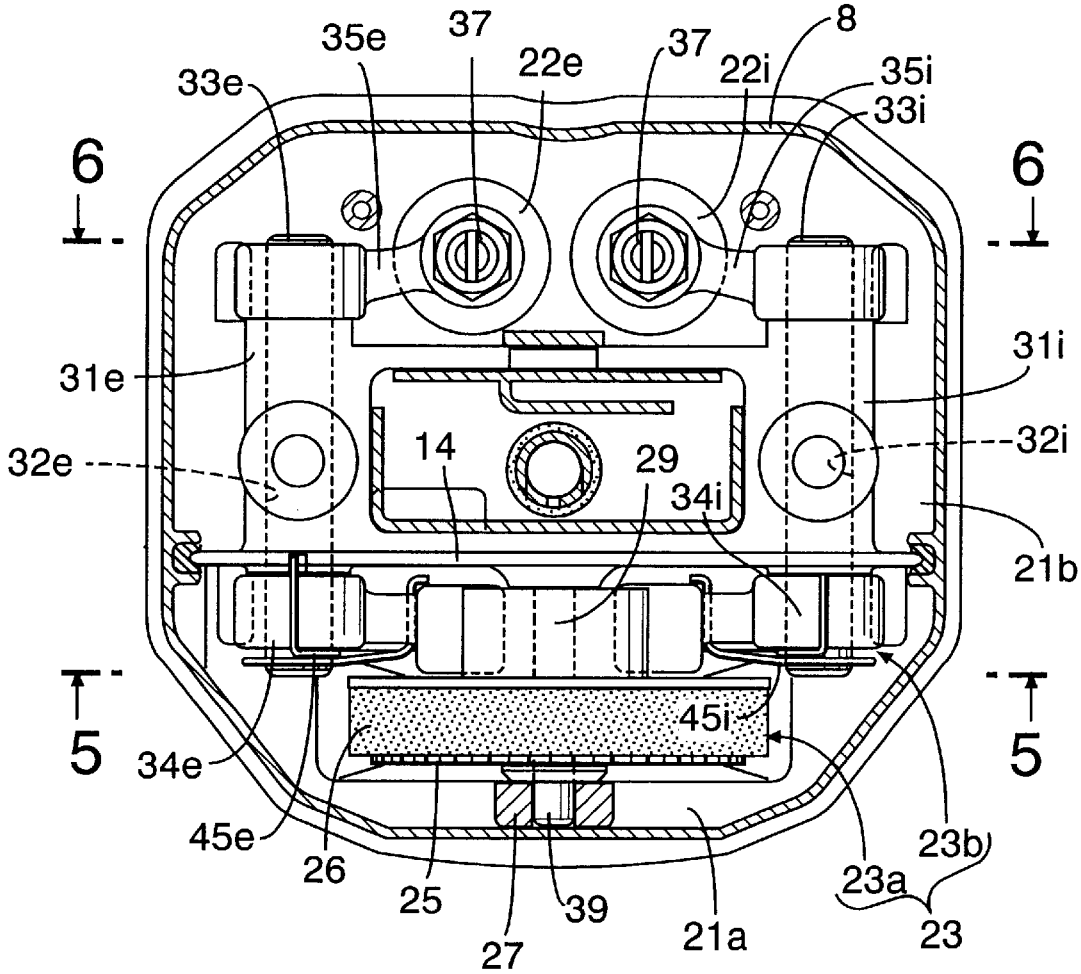
FIG. 4 is a sectional view taken along a line 4—4 in FIG. 3.
Figure 5:
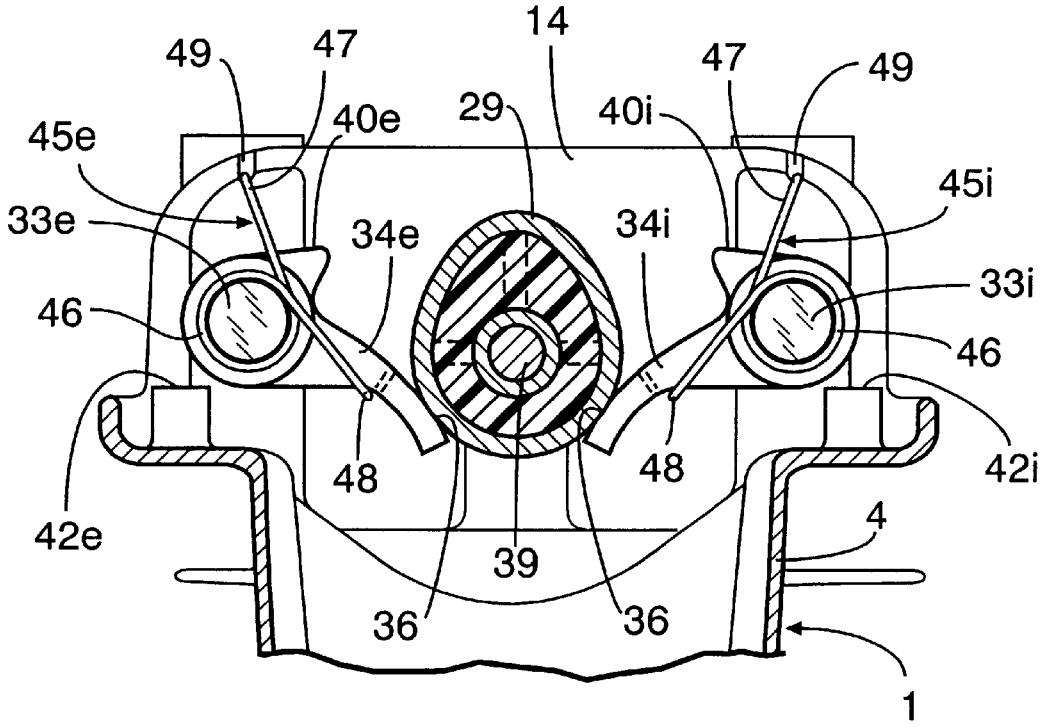
FIG. 5 is a sectional view taken along a line 5—5 in FIG. 4.
Figure 6:
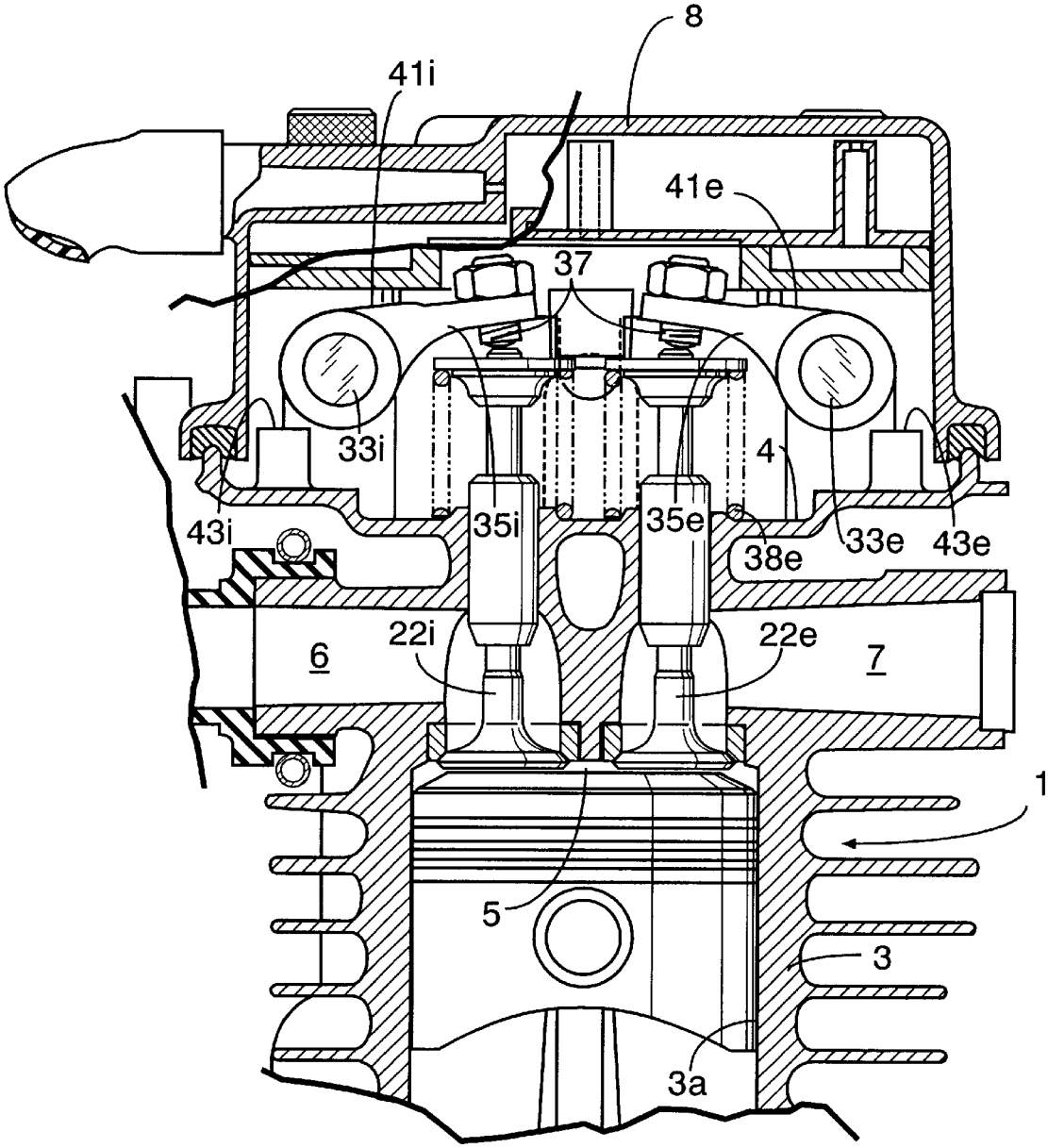
FIG. 6 is a sectional view taken along a line 6—6 in FIG. 4.

Referring to FIGS. 4 and 5, auxiliary springs 45*i* and 45*e* are interposed respectively between the cylinder head 4 and the intake cam follower 34*i* and between the cylinder head 4 and the exhaust cam follower 34*e* for urging the intake cam follower 34*i* and the exhaust cam follower 34*e* in acting directions of an intake spring 38*i* and an exhaust spring 38*e*. Each of the auxiliary springs 45*i* and 45*e* is a torsion spring including a coil portion 46 fitted over an outer periphery of corresponding one of the rocker shafts 33*i* and 33*e*, a stationary end 47 is locked to a locking portion 49 of the cylinder head 4, and a movable end 48 connected to corresponding one of the cam followers 34*i* and 34*e* to bias the cam follower 34*i*, 34*e* upwards.

Figure 9:
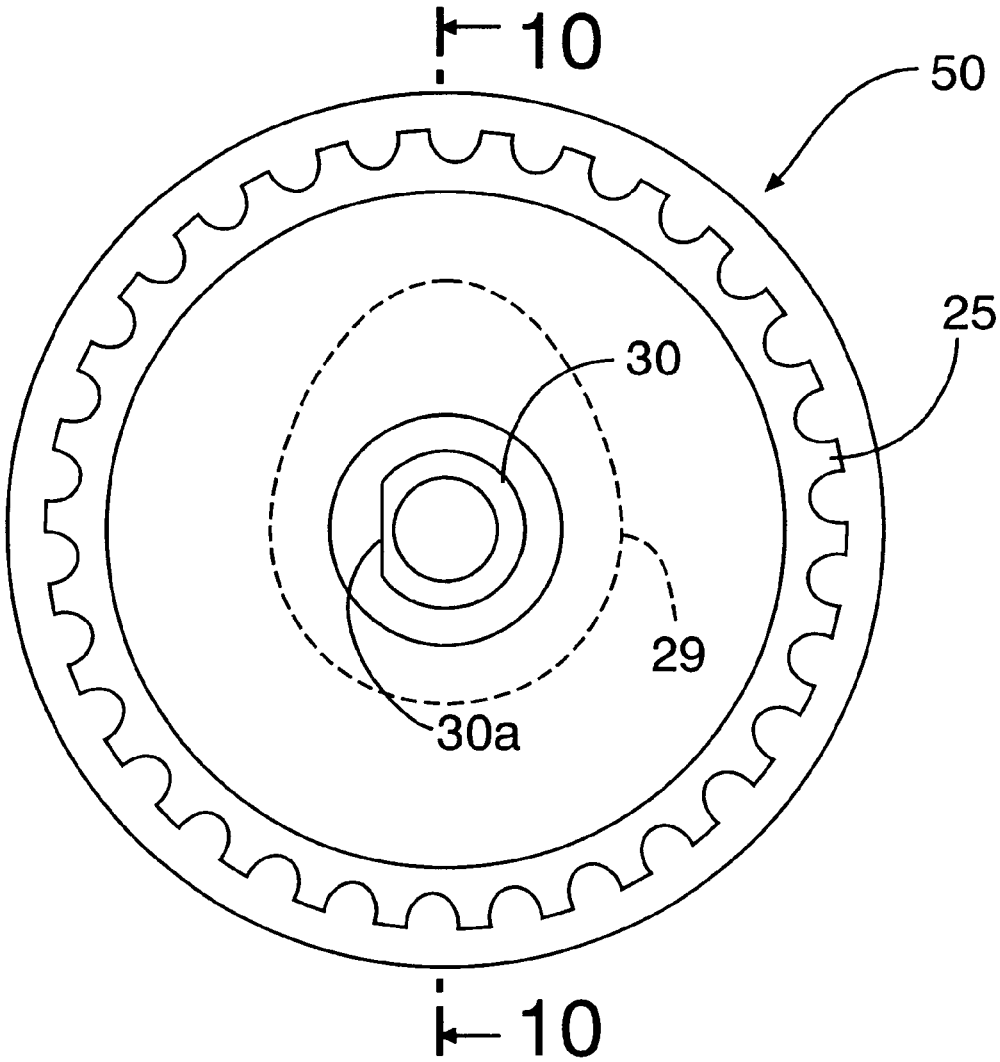
FIG. 9 is a front view of a driven pulley/cam assembly in the valve-operating mechanism.
Figure 10:
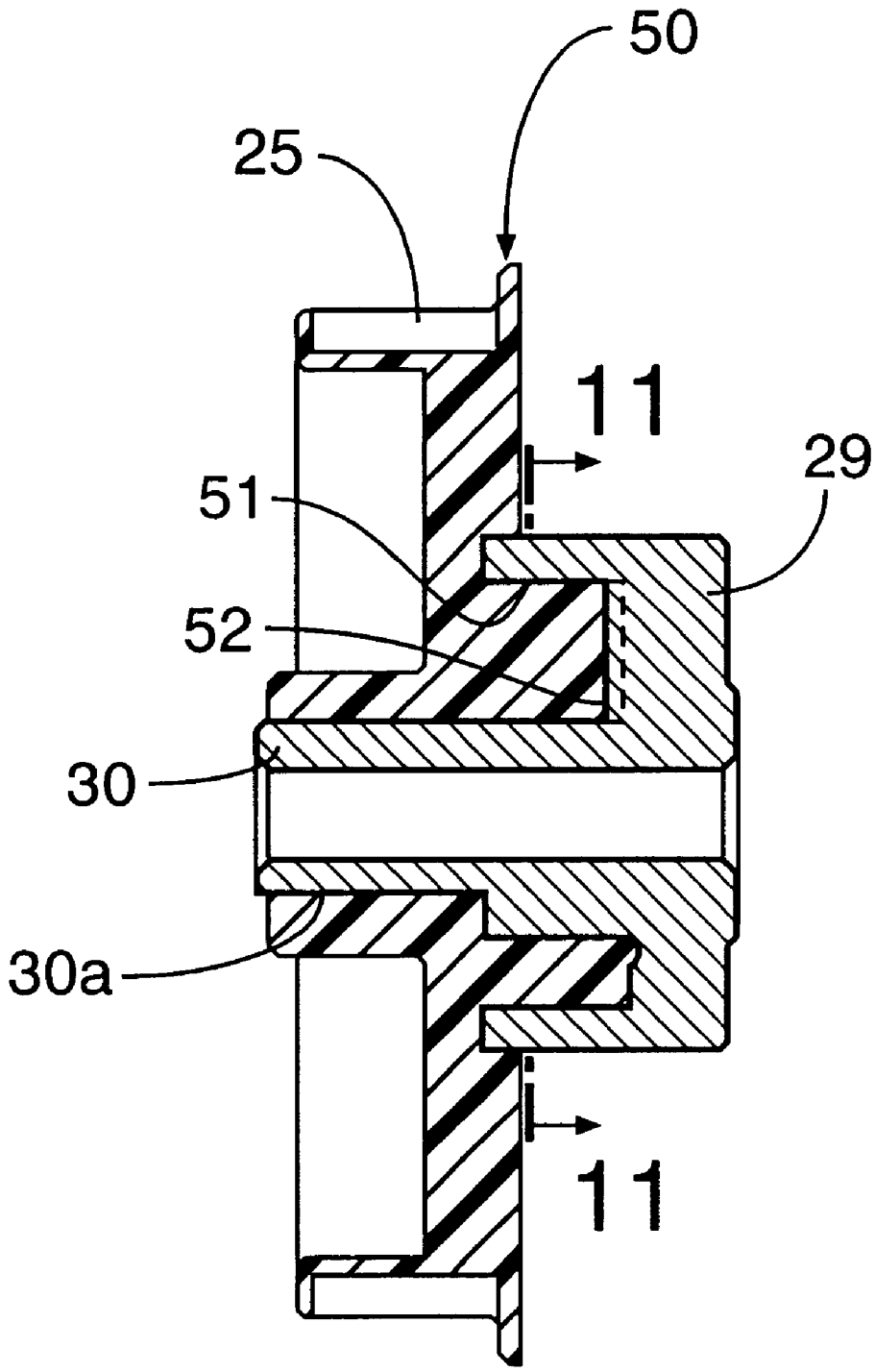
FIG. 10 is a sectional view taken along a line 10—10 in FIG. 9.
Figure 11:
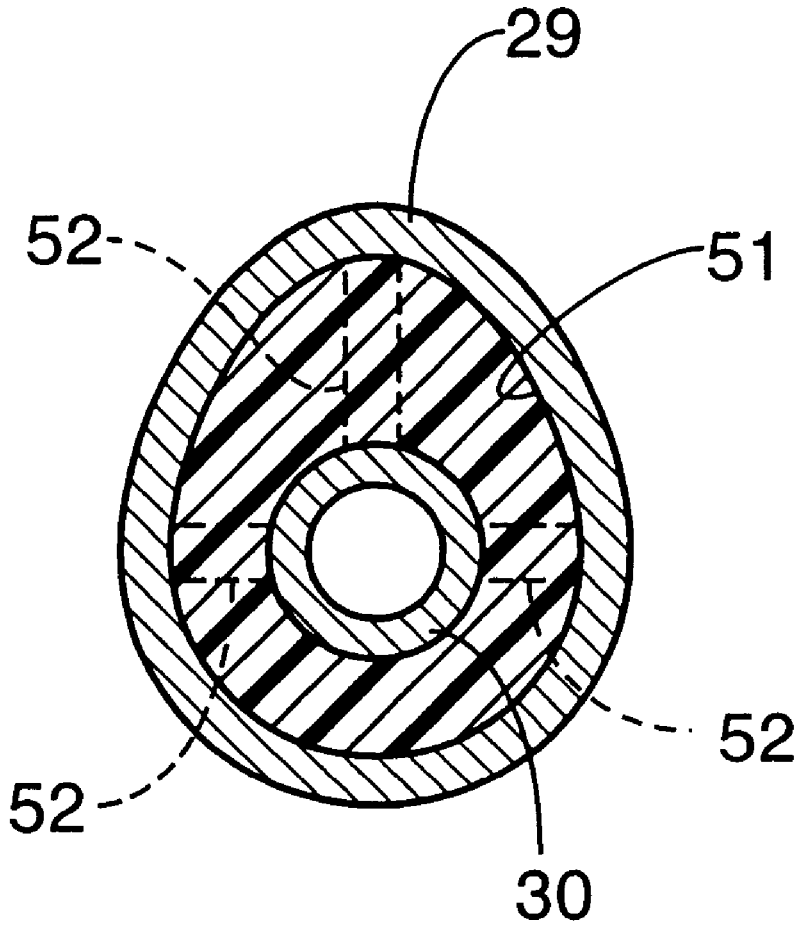
FIG. 11 is a sectional view taken along a line 11—11 in FIG. 10.

Referring to FIGS. 9 to 11, the cam 29 is formed of a sintered alloy integrally along with the cylindrical hub 30 rotatably carried on the support shaft 39. In this case, the hub 30 is disposed to protrude one end face of the cam 29, and has a chamfer 30*a* provided on an outer peripheral surface of its tip end. The cam 29 is provided at its one end face with a recess 51 surrounding the hub 30, and a radial projection 52 protruding on a bottom surface of the recess 51. The recess 51 is of a shape substantially similar to an outer peripheral surface of the cam 29, so that the wall thickness of the cam 29 around the recess 51 is set substantially constant.

The driven pulley 25 made of a synthetic resin is mold-coupled to the hub 30 and the cam 29. In this process, the outer peripheral surface of the hub 30 as well as the chamfer 30*a* are wrapped by the material of the driven pulley, i.e., the synthetic resin, and the recess 51 in the cam 29 is filled with the synthetic resin. In this manner, the driven pulley/cam assembly 50 is constituted.

Referring again to FIGS. 1 and 2, a specified amount of a lubricating oil O injected through an oil supply port 12*a* is stored in the oil tank 12. A pair of oil slingers 55*a* and 55*b* are secured by press-fitting or the like to the crankshaft 13 in the oil tank 40, and arranged axially on opposite sides of the driving pulley 24. The oil slingers 56*a* and 56*b* extend radially opposite directions, and bent so that their tip ends are axially going away from each other. When the oil slingers 56*a* and 56*b* are rotated by the crankshaft 13, at least one of the oil slingers 56*a* and 56*b* agitates and scatters the oil O stored in the oil tank 40 to produce an oil mist, even in any operative position of the engine E. At this time, the produced oil mist enters the first valve-operating chamber 21*a* to lubricate the timing transmitting device 23*a*, and on the other hand is circulated to the crank chamber 6*a*, the second valve-operating chamber 21*b* and the oil tank 12 to lubricate various portions within the crank chamber 2*a* and the cam device 22*b*.

The operation of this embodiment will be described below.

When the driving pulley 24 rotated along with the crankshaft 10 during rotation of the crankshaft 10 drives the driven pulley 25 and the cam 29 through the belt 26, the cam 9 properly swings the intake and exhaust cam followers 32*i* and 32*e*. The swinging movements are transmitted through the corresponding rocker shafts 33*i* and 33*e* to the intake and exhaust rocker arms 35*i* and 35*e*, to swing the intake and exhaust rocker arms 35*i* and 35*e*. Therefore, the intake and exhaust valves 22*i* and 22*e* can be opened and closed properly by cooperation with the intake and exhaust springs 38*i* and 38*e*.

During this process, the cam 29 and the hub 30 are lubricated by the oil mist produced within the oil tank 12. However, the cam 29 and the hub 30 are made of a sintered alloy having an infinite number of pores, and hence the oil is retained in the pores. Thus, portions of the cam 29 and the hub 30 in sliding contact with the cam followers 34*i* and 34*e* and portions of the cam 29 and the hub 30 rotated and slid on the support shaft 39 are effectively lubricated so that the wear thereof is prevented. This can contribute to an enhancement in durability of such portions.

Moreover, the hub 30 is rotatably carried on the support shaft 39, and the support shaft 39 is also rotatably carried on the opposite sidewalls of the first valve-operating chamber 21*a*. Therefore, during rotation of the driven pulley 25 and the cam 29, the support shaft 39 is also rotated, dragged by the friction, and hence a difference between rotational speeds of the hub 30 and the support shaft 39 is decreased. This can provide a reduction in wear of the rotated and slid portions, which can contribute to a further enhancement in durability of the rotated and slid portions.

In addition, the driven pulley 25 driven by the driving pulley 24 through the belt 26 is made of the synthetic resin, and hence is relatively lightweight in spite of its relatively large diameter, which can contribute to a reduction in weight of the driven pulley/cam assembly 50 and in its turn to a reduction in weight of the engine E.

Moreover, because the driven pulley 25 is mold-coupled to the cam 29 and the hub 30, the driven pulley/cam assembly 50 can be constructed without a special member, leading to a further reduction in weight of the assembly 50.

Further, when the driven pulley 25 is mold-coupled to the cam 29 and the hub 30, the outer peripheral surface of the hub 30 as well as the chamfer 30*a* are wrapped by the material of the driven pulley 25, i.e., the synthetic resin, and the recess 51 in the cam 29 is filled with the synthetic resin, and hence coupling forces between the driven pulley 25 and the hub 30 as well as the cam 29 in rotational and axial directions can be increased.

Particularly, because the recess 51 is of the shape substantially similar to the outer peripheral surface of the cam 29, the coupling force between the driven pulley 25 and the cam 29 particularly in the rotational direction can be effectively increased. Moreover, because the wall thickness of the cam 29 around the recess 51 is substantially constant, the thermal deformation of the cam 29 during sintering thereof can be suppressed to contribute to an enhancement in accuracy of a cam profile.

When the intake cam follower 34*i* and the exhaust cam follower 34*e* respectively ride on a base-circle portion of the cam 29, and in response to the release of downward urging forces on the cam followers, the intake valve 22*i* and the exhaust valve 22*e* are closed by biasing forces of the intake spring 38*i* and the exhaust spring 38*e*, the rocker arms 35*i* and 35*e* are then pushed upwards by the intake valve 22*i* and the exhaust valve 22*e* and are swung about their axes, to act on one end of each of the rocker shafts 33*i* and 33*e* so as to push them up and to apply a couple of forces to the rocker shafts 33*i* and 33*e*.

However, upward urging forces are always applied to the other ends of the rocker shafts 33*i* and 33*e* by the biasing forces of the auxiliary springs 45*i* and 45*e* connected to the cam followers 34*i* and 34*e*, and the couple of forces are negated by the urging forces. As a result, the rocker shafts 33*i* and 33*e* are entirely urged against upper surfaces of the bearing bores 32*i* and 32*e*, and hence it is possible to previously avoid the chattering due to the couple of forces and to previously prevent generation of an abnormal sound and a striking wear.

The cam 29 of the relatively large diameter is disposed along with the driven pulley 25 on one side of the cylinder head 4, and only the intake and exhaust rocker arms 35*i* and 35*e* and the intake and exhaust rocker shafts 33*i* and 33*e* of the relatively small diameter are disposed immediately above the cylinder head 4. Therefore, the valve-operating mechanism 23 cannot overhang largely above the cylinder head 4, and hence it is possible to provide a reduction in entire height of the engine E, and in turn provide the compactness of the engine E.

The cam followers 34*i* and 34*e* and the rocker arms 35*i* and 35*e* secured to the opposite ends of the rocker shafts 33*i* and 33*e* have their abutment faces 40*i* and 40*e* put into abutment against the reference faces 42*i*, 42*e*, 43*i* and 43*e* of the cylinder head 4 during assembling of the cam followers 34*i* and 34*e* and the rocker arms 35*i* and 35*e*, whereby the phases of the intake cam follower 34*i* and the intake rocker arm 35*i* around the rocker shafts 33*i* and 33*e* are appropriately established. Therefore, the intake and exhaust valves 22*i* and 22*e* can be opened and closed with a good timing by rotation of the cam 29.

Particularly, during assembling, for example, each of the cam followers 34*i* and 34*e* is press-fitted to one end of each of the rocker shafts 33*i* and 33*e*, and the rocker shafts 33*i* and 33*e* are fitted into the bearing bores 32*i* and 32*e* in the bearing bosses 31*i* and 31*e* and thereafter, the rocker arms 35*i* and 35*e* are press-fitted to the other ends of the rocker shafts 33*i* and 33*e*. At this time, the abutment faces 41*i* and 41*e* of the rocker arms 35*i* and 35*e* are press-fitted to the corresponding reference faces 43*i* and 43*e*, while being put into abutment against the corresponding reference faces 43*i* and 43*e*. Therefore, the appropriate phases of the cam followers 34*i* and 34*e* and the rocker arms 35*i* and 35*e* can be confirmed simultaneously with the coupling of the cam followers 34*i* and 34*e* and the rocker arms 35*i* and 35*e* to the rocker shafts 33*i* and 33*e*, whereby both the quality and the productivity of them can be satisfied.

Although the embodiment of the present invention has been described in detail, it will be understood that the present invention is not limited to the above-described embodiment, and various modifications in design may be made without departing from the spirit and scope of the invention defined in the claims.

What is claimed is:

1. A valve-operating assembly of a driven rotation member and a cam, comprising a hub rotatably carried on a support shaft supported on an engine body, a cam formed on an outer periphery of one end of said hub, and a driven rotation member coupled to one end of said cam, wherein said cam and said hub are integrally formed of a sintered alloy;

wherein said cam has a recess surrounding said hub defined in one end face thereof; and wherein said driven rotation member is made of a synthetic resin, and mold-coupled to said cam and said hub so that said recess is filled with the synthetic resin of said driven rotation member and an outer periphery of said hub is wrapped with the synthetic resin.

2. A valve-operating assembly of a driven rotation member and a cam according to claim 1, wherein said recess is formed so that the shape of its inner surface substantially corresponds to that of an outer peripheral surface of said cam.

* * * * *